US005605271A

United States Patent [19]

Russell

[11] Patent Number: 5,605,271

[45] Date of Patent: Feb. 25, 1997

[54] NAIL DRIVER

[76] Inventor: Michael W. Russell, 2100 Dove Loop Rd. #27, Grapevine, Tex. 76051

[21] Appl. No.: 463,625

[22] Filed: Jun. 6, 1995

[51] Int. Cl.[6] ..... B25D 1/02

[52] U.S. Cl. ..... 227/147; 173/90

[58] Field of Search ..... 227/147, 149, 227/113; 173/90, 91

[56] References Cited

U.S. PATENT DOCUMENTS

| | | | |
|---|---|---|---|
| 541,038 | 6/1895 | Clark | 227/147 |
| 608,555 | 8/1898 | Nazel | 227/147 |
| 620,426 | 2/1899 | Danzer . | |
| 1,155,724 | 10/1915 | Harnly | 227/147 |
| 2,430,532 | 11/1947 | Rayburn | 227/147 |
| 2,587,944 | 3/1952 | Williams | 227/147 |
| 2,727,235 | 12/1955 | Cameron | 227/147 |
| 2,786,202 | 3/1957 | Gaulke | 227/147 |
| 2,829,370 | 4/1958 | Humbert | 227/147 |
| 2,902,690 | 9/1959 | Hamlin | 227/147 |
| 2,973,527 | 3/1961 | Maynard et al. | 7/15 |
| 3,036,482 | 5/1962 | Kenworthy et al. | 81/52.35 |
| 3,119,423 | 1/1964 | Weick | 145/50 |
| 3,934,779 | 1/1976 | Dent | 227/147 |
| 3,979,040 | 9/1976 | Denin | 227/113 |
| 4,085,882 | 4/1978 | Stamper | 227/110 |
| 4,120,438 | 10/1978 | Litch | 227/147 |
| 4,483,475 | 11/1984 | Whitaker | 227/147 |
| 4,562,948 | 1/1986 | Floyd | 227/147 |
| 4,709,841 | 12/1987 | Wollar | 227/147 |
| 4,785,692 | 11/1988 | Holmes | 81/27 |
| 4,834,342 | 5/1989 | Padgett | 227/147 |
| 4,838,471 | 6/1989 | Chiesa | 227/142 |
| 5,109,739 | 5/1992 | Hull et al. | 81/463 |
| 5,123,584 | 6/1992 | Harrison | 227/147 |
| 5,165,588 | 11/1992 | Rowland | 227/147 |
| 5,370,192 | 12/1994 | Evinger | 173/90 |

*Primary Examiner*—Scott A. Smith

*Attorney, Agent, or Firm*—H. Dennis Kelly; Timmons & Kelly

[57] ABSTRACT

A nail is held within a cylindrical nail chamber by a magnetized cylindrical driver rod. A driver sleeve is concentric with the nail chamber, and attached to the rearward end of the driver rod. As the driver sleeve is moved toward a surface, the driver rod drives the nail into the surface. A coil spring, attached between a chamber guide nut on the driver sleeve and the nail chamber, biases the nail driver in the extended position. A reinforcement cap between the driver rod and the driver sleeve is adjustable to adjust the distance that the nail is driven into the surface.

6 Claims, 1 Drawing Sheet

NAIL DRIVER

BACKGROUND OF THE INVENTION

1. Field of the Invention

This invention relates in general to hand tools. In particular, the invention relates to hand tools for driving nails.

2. Description of Related Art

There are many circumstances in which it is difficult to drive a nail, particularly using a hammer. For example, a nail may need to be driven into a small area, or into a corner. A pipe or some other obstruction may hamper the use of a hammer on the nail.

Hand held nail drivers have been devised for use in circumstances in which a hammer is impractical. For example, U.S. Pat. No. 4,483,475, issued Nov. 20, 1984, to Whitaker, discloses a simple hand held nail driver. The Whitaker device includes a cylindrical guide tube and a plunger rod. A handle is mounted on one end of the plunger rod, and the plunger rod is inserted into the guide tube. A nail is placed into the guide tube, and the handle is moved to cause the plunger rod to strike the nail, driving the nail into a surface. The guide tube is then held in place, as the handle is pulled back to retract the plunger rod from the guide tube.

SUMMARY OF THE INVENTION

The general object of the nail driver of the invention is to drive nails into a surface, without an external power source or an undue amount of physical exertion. In general, this object is accomplished by a nail driver having a nail chamber, a driver rod, and a driver sleeve, which are concentric to one another. A nail is held within the nail chamber by the magnetized driver rod.

The driver sleeve is connected to the rearward end of the driver rod, and extends over the rearward end of the nail chamber. As the driver sleeve is moved forward over the nail chamber, the driver rod moves forward within the nail chamber, driving the nail forward.

A chamber guide nut is attached to the forward end of the driver sleeve, and a coil spring is attached between the chamber guide nut and the rearward end of the nail chamber. The coil spring biases the nail driver toward the extended position.

The driver sleeve is connected to the driver rod, by a reinforcement cap, secured to the rearward end of the driver rod and threaded onto the rearward end of the driver sleeve. The reinforcement cap can be rotated to move the driver rod forward or rearward relative to the driver sleeve, to adjust the distance that the nail is driven into the surface.

A removable depression cap is attached to the forward end of the nail chamber. The depression cap provides an increased area of impact, to reduce damage to the surface as the nail is driven into the surface. The depression cap can be removed to allow the nail chamber to be positioned through a drilled hole or into a smaller space.

The above, as well as additional objects, features, and advantages of the invention will become apparent in the following detailed description.

DESCRIPTION OF THE PREFERRED EMBODIMENT

Figure 1:
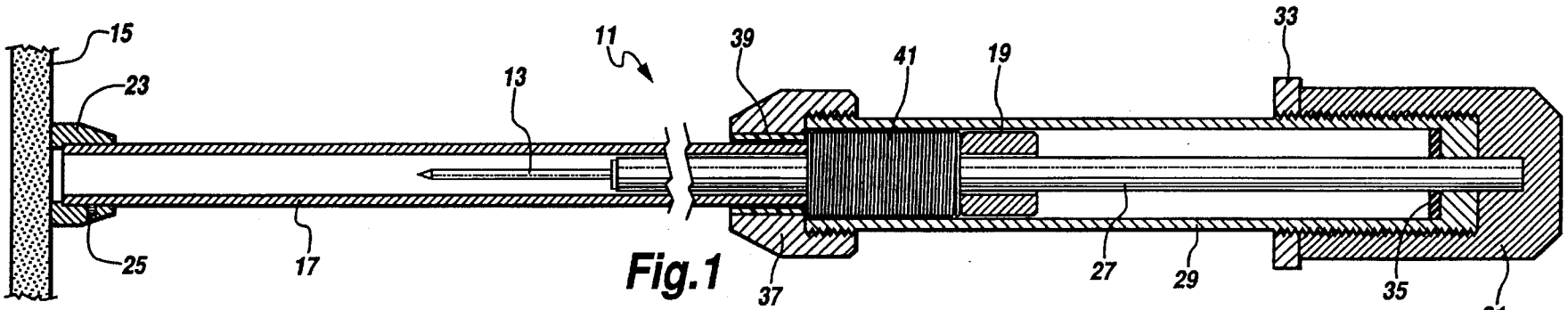
FIG. 1 is a cross sectional side elevation of a nail driver according to the invention, with the nail driver in the extended position.
Figure 2:
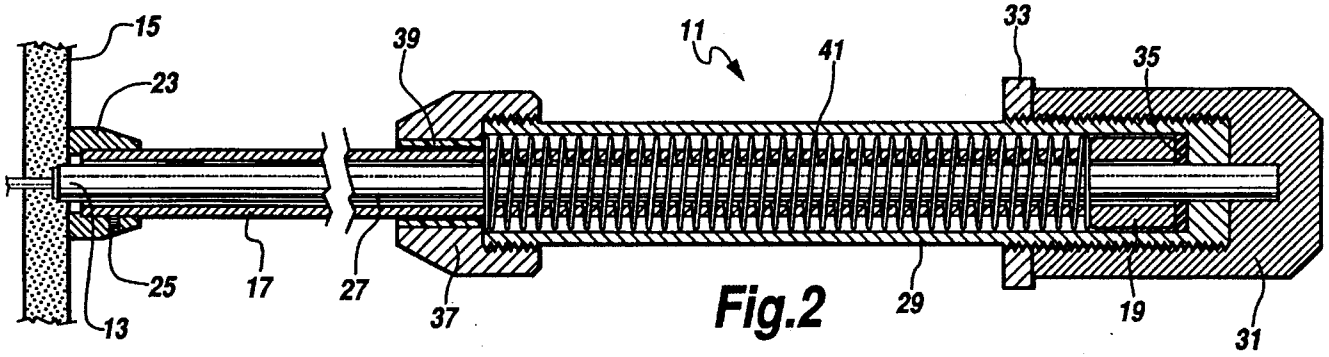
FIG. 2 is a cross sectional side elevation of a nail driver according to the invention, with the nail driver in the retracted position.

The preferred embodiment of the nail driver 11 of the invention is illustrated in FIGS. 1 and 2. The nail driver 11 is movable between an extended position, shown in FIG. 1, and a retracted position, shown in FIG. 2.

The nail driver 11 drives a standard nail 13, such as a sixteen penny nail, into a wall 15. The nail 13 is housed within a hollow cylindrical nail chamber 17. The nail driver 11 can be made in various sizes for driving nails 13 of various sizes. For a sixteen penny nail 13, the nail chamber 17 will have an outside diameter of about one half inch (1.27 centimeters), and an inner diameter of about three eighths of an inch (0.95 centimeters). The rearward end 19 of the nail chamber 17, farthest from the wall 15, has an increased outer diameter of about three quarters of an inch (1.90 centimeters), for a distance of about three quarters of an inch (1.90 centimeters). The nail chamber will be about thirty iches (76.2 centimeters) long.

The forward end of the nail chamber 17, closest to the wall 15, receives a depression cap 23. A one eighth inch (0.32 centimeter) allen set screw 25 secures the depression cap 23 to the nail chamber 17. The forward end of the depression cap 23 has an increased outer diameter to provide some stability to the forward end of the nail chamber 17, and to reduce the impact of the nail driver 11 on the surface 15. The depression cap 23 can be removed to allow the nail chamber 17 to be inserted through a drilled hole, or to be placed in a small space.

The nail 13 is held within the nail chamber 17 by a solid cylindrical driver rod 27. The driver rod 27 is concentric with the nail chamber 17 and has an outer diameter of about five sixteenths of an inch (0.79 centimeter), slightly smaller than the inner diameter of the nail chamber 17, so that the driver rod 27 can move through the nail chamber 17. In this embodiment, the driver rod 27 is about 14.5 inches (36.8 centimeters) long.

The driver rod 27 is magnetized to hold the nail 13 against the forward end of the driver rod 27. The flat head of the nail 13 lies flat against the forward end of the driver rod 27, so that the shaft of the nail 13 is held centered within the nail chamber 17. The driver rod 27 extends beyond the rearward end 19 of the nail chamber 17, and passes through a hole in the rearward end of a driver sleeve 29. The rearward end of the driver rod 27 is welded into a hole in a reinforcement cap 31.

External threads on the driver sleeve 29 allow the driver sleeve 29 to be threaded into internal threads on the reinforcement cap 31. As the reinforcement cap 31 is rotated, the driver rod 27 is moved forward or rearward relative to the driver sleeve 29. This adjustment changes the distance that the nail 13 is driven into the surface 15. At the maximum setting, shown in FIGS. 1 and 2, the nail 15 will be countersunk about one eighth inch (0.32 centimeter).

A lock down nut 33 secures the driver sleeve 29 to the reinforcement cap 31 to prevent unintentional unthreading. The lock down nut 33 has internal threads that cooperate with the external threads of the driver sleeve 29. The lock down nut 33 can be tightened against the end of the reinforcement cap 31 to prevent the reinforcement cap 31 from rotating relative to the driver sleeve 29. The lock down nut 33 may have ridges around its circumference to facilitate hand tightening of the nut 33.

The driver sleeve 29 is generally a hollow cylinder, having an inner diameter slightly larger than the outer diameter of the rearward end 19 of the nail chamber 17. Therefore, the driver rod 27 and the driver sleeve 29 can move longitudinally relative to the nail chamber 17, with rearward end 19 of the nail chamber 17 between the driver rod 27 and the driver sleeve 29.

An energy absorbing washer 35 is located within the driver sleeve 29, against the rearward end of the driver sleeve 29. The washer 35 is about one eighth inch (0.32 centimeter) wide, and absorbs energy when the nail driver 11 is moved to the retracted position, as shown in FIG. 2. The driver sleeve 29 and the driver rod 27 can be moved forward until the rearward end 19 of the nail chamber 17 strikes the energy absorbing washer 25.

The forward end of the driver sleeve 29 has external threads, and a chamber guide nut 37 having internal threads, is threaded onto the forward end of the driver sleeve 29. The chamber guide nut 37 extends forward of the driver sleeve 29, and has an inner diameter only slightly larger than the outer diameter of the nail chamber 17. A plastic or rubber bushing 39 is mounted between the chamber guide nut 37 and the nail chamber 17 to facilitate movement of the chamber guide nut 37 along the length of the nail chamber 17.

A coil spring 41 is attached between the chamber guide nut 37 and the rearward end 19 of the nail chamber 17. The coil spring 41 is wound relatively tightly, and thus biases the nail driver 11 toward the extended position, as shown in FIG. 1.

In operation, the nail driver 11 of the invention is very easy to use. First, a nail 13 is inserted, head first, into the forward end of the nail chamber 17. The nail 13 will fall until the head of the nail 13 attaches to the magnetic forward end of the driver rod 27.

The depression cap 23 is then placed against the wall 15 at the point at which the nail 13 is to be driven. The nail driver 11 can be held in place with one hand. With that hand, the driver sleeve 29 is pushed forward, causing the reinforcement cap 31, the driver rod 27, and the nail 13 to also move forward. When the nail 13 reaches the wall 15, the nail 13 will be driven at least partially into the wall 15.

When pressure on the driver sleeve 29 is released, the coil spring 41 causes the nail driver 11 to return to its extended position. The driver sleeve 29 can then be pushed forward a second time. When the driver rod 27 reaches the nail 13, the nail 13 will be driven further into the wall 15.

This process can be repeated, until the energy absorbing washer 35 strikes the rearward end 19 of the nail chamber 17. At that point, the nail 13 will not be driven any further into the wall 15. The reinforcement cap 31 can be adjusted to allow the nail 13 to be countersunk, if desired.

The nail driver 11 of the invention has several advantages over the prior art. The simple design allows the nail driver 11 to be manufactured inexpensively. The device is easy to assemble, to adjust, and to repair. Also, the various adjustments available give the device a great amount of versatility.

The invention has been described in only one embodiment. It should be apparent to those skilled in the art that the invention is not so limited, but is susceptible to various changes and modifications without departing from the spirit of the invention.

I claim:

1. A nail driver for driving a nail having an outer diameter into a surface, wherein the nail driver comprises:

a hollow nail chamber having an inner diameter that is larger than the outer diameter of the nail, and having an outer diameter, a forward end, and a rearward end;

a solid driver rod, concentric with the nail chamber and having a forward end for contacting the nail and a rearward end extending beyond the rearward end of the nail chamber;

a hollow driver sleeve having an inner diameter larger than the outer diameter of the nail chamber a forward end, and a rearward end, wherein the rearward end of the driver sleeve is connected to the rearward end of the driver rod, and wherein the forward end of the driver sleeve extends past the rearward end of the nail chamber;

a chamber guide nut attached to the forward end of the driver sleeve; and a coil spring attached between the chamber guide nut and the rearward end of the nail chamber.

2. A nail driver as recited in claim 1, further comprising a bushing between the chamber guide nut and the nail chamber.

3. A nail driver as recited in claim 1, further comprising an energy absorbing washer located within the driver sleeve for contacting the rearward end of the nail chamber.

4. A nail driver for driving a nail having an outer diameter into a surface, wherein the nail driver comprises:

a hollow nail chamber having an inner diameter that is larger than the outer diameter of the nail, and having an outer diameter, a forward end, and a rearward end;

a solid driver rod, concentric with the nail chamber and having a forward end for contacting the nail and a rearward end extending beyond the rearward end of the nail chamber;

a hollow driver sleeve having an inner diameter larger than the outer diameter of the nail chamber, a forward end, and a rearward end, wherein the rearward end of the driver sleeve is connected to the rearward end of the driver rod, and wherein the forward end of the driver sleeve extends past the rearward end of the nail chamber; and an adjustable depression cap attached to the forward end of the nail chamber.

5. A nail driver as recited in claim 8, wherein the depression cap is removable.

6. A nail driver for driving a nail having an outer diameter into a surface, wherein the nail driver comprises:

a hollow nail chamber having an inner diameter that is larger than the outer diameter of the nail, and having an outer diameter, a forward end, and a rearward end;

a solid driver rod, concentric with the nail chamber and having a forward end for contacting the nail and a rearward end extending beyond the rearward end of the nail chamber;

a hollow driver sleeve having an inner diameter larger than the outer diameter of the nail chamber, a forward end, and a rearward end, wherein the rearward end of the driver sleeve is connected to the rearward end of the driver rod, and wherein the forward end of the driver sleeve extends past the rearward end of the nail chamber;

a reinforcement cap attached between the driver rod and the driver sleeve, wherein the reinforcement cap is threaded onto the driver sleeve; and a lock down nut threaded onto the driver sleeve to prevent unintentional unthreading of the reinforcement cap from the driver sleeve.

* * * * *